US006053425A

United States Patent [19]

Stringfellow

[11] Patent Number: 6,053,425

[45] Date of Patent: Apr. 25, 2000

[54] INJECTOR

[75] Inventor: Christopher Stringfellow, Sittingbourne, United Kingdom

[73] Assignee: Lucas Industries, Solihull, United Kingdom

[21] Appl. No.: 08/968,483

[22] Filed: Nov. 12, 1997

[30] Foreign Application Priority Data

Nov. 12, 1996 [GB] United Kingdom ..... 9623469

[51] Int. Cl.[7] ..... B05B 9/00

[52] U.S. Cl. ..... 239/124; 239/533.3; 239/533.12; 239/585.1; 239/585.5; 239/125

[58] Field of Search ..... 239/533.3–533.12, 239/585.1–585.5, 124, 125

[56] References Cited

U.S. PATENT DOCUMENTS

| | | | |
|---|---|---|---|
| 3,118,611 | 1/1964 | Berlyn | 239/533.7 |
| 3,669,360 | 6/1972 | Knight | 239/533.8 X |
| 4,261,513 | 4/1981 | Andrews | 239/533.8 X |
| 4,436,247 | 3/1984 | Akagi | 239/533.9 X |
| 4,540,126 | 9/1985 | Yoneda et al. . | |
| 4,566,635 | 1/1986 | Trachte | 239/533.8 |
| 4,715,540 | 12/1987 | Miyake | 239/533.3 |
| 4,715,541 | 12/1987 | Freudenschuss et al. | 239/533.9 X |
| 4,899,935 | 2/1990 | Yoshida et al. | 239/533.8 X |
| 4,907,745 | 3/1990 | Messingschlager | 239/585.5 X |
| 4,909,440 | 3/1990 | Mitsuyasu et al. | 239/533.8 X |
| 5,020,500 | 6/1991 | Kelly . | |
| 5,209,403 | 5/1993 | Tarr et al. | 239/533.8 X |

FOREIGN PATENT DOCUMENTS

19520036A1 12/1995 Germany .

*Primary Examiner*—Kevin Weldon
*Attorney, Agent, or Firm*—Price, Heneveld, Cooper, DeWitt & Litton

[57] ABSTRACT

An injector includes a nozzle body having a bore and defining a seating, and a fuel flow path along which fuel flows, in use, towards the seating. A needle is slidable through a range of movement within the bore, and engagable with the seating to control fuel flow to an outlet aperture. The needle includes a thrust surface against which fuel at high pressure acts, in use, to lift the needle from its seating. The bore and needle together define a restriction to the flow of fuel along the fuel flow path towards the seating. The restriction is located upstream of the thrust surface, and the restriction is arranged to restrict the rate of flow of fuel towards the seating throughout the range of movement of the needle. In a preferred embodiment, the restriction is arranged such that the rate of fuel flow towards the seating through the restriction varies as the needle separates from the seating.

8 Claims, 3 Drawing Sheets

INJECTOR

BACKGROUND OF THE INVENTION

This invention relates to an injector for use in supplying fuel to a cylinder of an internal combustion engine.

In order to reduce the combustion noise and emissions levels of an engine, it is desirable to supply each cylinder of the engine with a relatively small quantity of fuel followed by a main injection during which most of the fuel is supplied to the cylinder. The fuel may be supplied either by supplying two separate injections, a pilot injection followed by a main injection, or alternatively, the injector may be arranged to supply fuel at an initial, low rate, subsequently supplying, fuel at a higher rate during each injection.

A number of two-rate injectors are known in which a restriction is defined between a needle of the injector and the wall defining a bore within which the needle is slidable. In use, when the needle is lifted from its seating by a small amount, the restriction acts to limit the rate at which fuel is supplied towards the seating, and hence the injection rate. Subsequently, the needle is lifted from its seating by a greater amount, such movement of the needle increasing the flow area through the restriction to a sufficient extent that the fuel flow therethrough is substantially unrestricted, hence permitting fuel to flow towards the seating at an increased rate, thus permitting the injection rate to increase.

In such two-rate injectors, in order to control the injection rate, the rate of lifting of the injection needle away from its seating needs to be accurately controlled, and such control is difficult to achieve consistently.

It is an object of the invention to provide a two-rate injector of relatively simple construction.

SUMMARY OF THE INVENTION

According to the present invention there is provided an injector comprising a nozzle body provided with a bore and defining a seating, a needle slidable within the bore and engageable with the seating, the needle including a thrust surface against which fuel at high pressure acts, in use, to lift the needle from its seating, the bore and needle together defining a restriction to the flow of fuel towards the seating, the restriction being located upstream of the thrust surface, wherein the restriction is arranged to restrict the rate of flow of fuel towards the seating throughout the range of movement of the needle.

By restricting the flow rate towards the seating throughout the range of movement of the needle, the fuel pressure acting on the thrust surface is relatively low as the needle is lifting from its seating, thus control of the injector can be simplified.

The restrictor is conveniently arranged such that the rate of fuel flow towards the seating through the restrictor is dependent upon the separation of the needle from the seating. Such an arrangement is advantageous in that the initial injection rate is low, the injection rate increasing as the injector is lifted from its seating.

The invention will further be described, by way of example, with reference to the accompanying drawings.

BRIEF DESCRIPTION OF THE DRAWINGS

The injector illustrated in the accompanying drawings comprises a nozzle body 10 having a blind bore formed therein, a valve needle 12 being slidable within the bore. The valve needle 12 includes a conical end region 14 which is engageable with a seating defined by a part of the bore adjacent the blind end thereof. As illustrated in FIG. 2, the blind end of the bore communicates with outlet apertures 15 which are located downstream of the seating.

Figure 1:
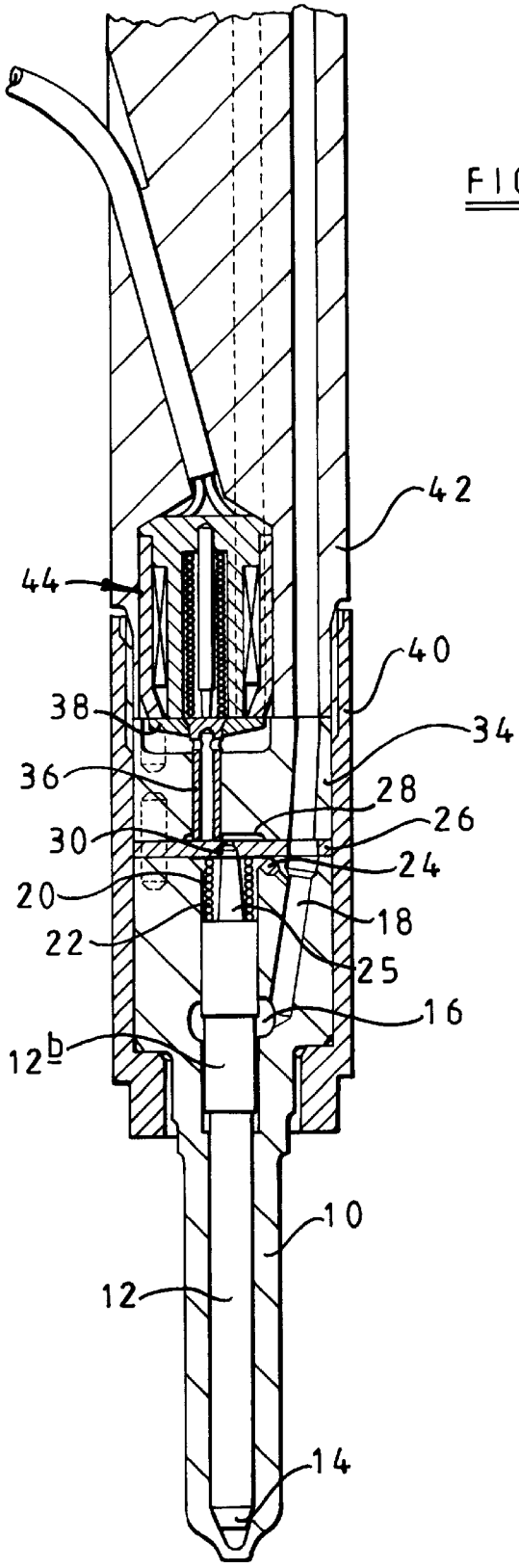
FIG. 1 is a cross-sectional view of an injector in accordance with an embodiment of the invention.

The bore includes an enlarged region which defines an annular gallery 16 which communicates with a supply passage 18 through which fuel at high pressure is supplied from a suitable source.

The nozzle body 10 abuts a first distance piece 26, the nozzle body 10 and first distance piece 26 defining a control chamber 20 housing a spring 22. The spring 22 is engaged between an end face of the needle 12 and the first distance piece 26 in order to bias the needle 12 towards the seating The control chamber 20 communicates through a restricted passage 24 provided in the nozzle body 10 with the supply passage 18. The needle 12 includes a projection 25 which acts as a guide for the spring 22 and also acts as a stop, movement of the needle 12 being limited by engagement of the projection 25 with the first distance piece 26.

A second distance piece 34 abuts the surface of the first distance piece 26 facing away from the nozzle body 10, the second distance piece 34 including a recess which defines with the first distance piece 26 a chamber 28 which communicates through a passage 30 provided in the first distance piece 26 with the control chamber 20. The second distance piece 34 further includes a bore which communicates with the chamber 28, a valve member 36 being slidable within the bore, an end of the valve member 36 being sealingly engageable with the first distance piece 26. As illustrated in FIG. 1, the valve member 36 is of tubular form, and when the valve member 36 is lifted away from the first distance piece 26 the recess 28 communicates through the passage defined by the valve member 36 with a suitable low pressure drain. Engagement of the valve member 36 with the first distance piece 26 prevents such flow of fuel from the chamber 28.

The end of the valve member 36 remote from the first distance piece 26 has an armature 38 secured thereto, the armature being moveable under the influence of an electromagnetic actuator 44 to control movement of the valve member 36. A spring biases the valve member 36 into engagement with the first distance piece 26.

The electromagnetic actuator 44 is located within a recess provided in a nozzle holder 42, a cap nut 40 being in threaded engagement with the nozzle holder 42 to secure the nozzle body 10 and first and second distances pieces 26, 34 to the nozzle holder 42. The nozzle holder 42 and first and second distance pieces 26, 34 each include drillings which communicate with the supply passage 18 provided in the nozzle body 10 whereby fuel at high pressure is supplied to the supply passage 18.

Figure 2:
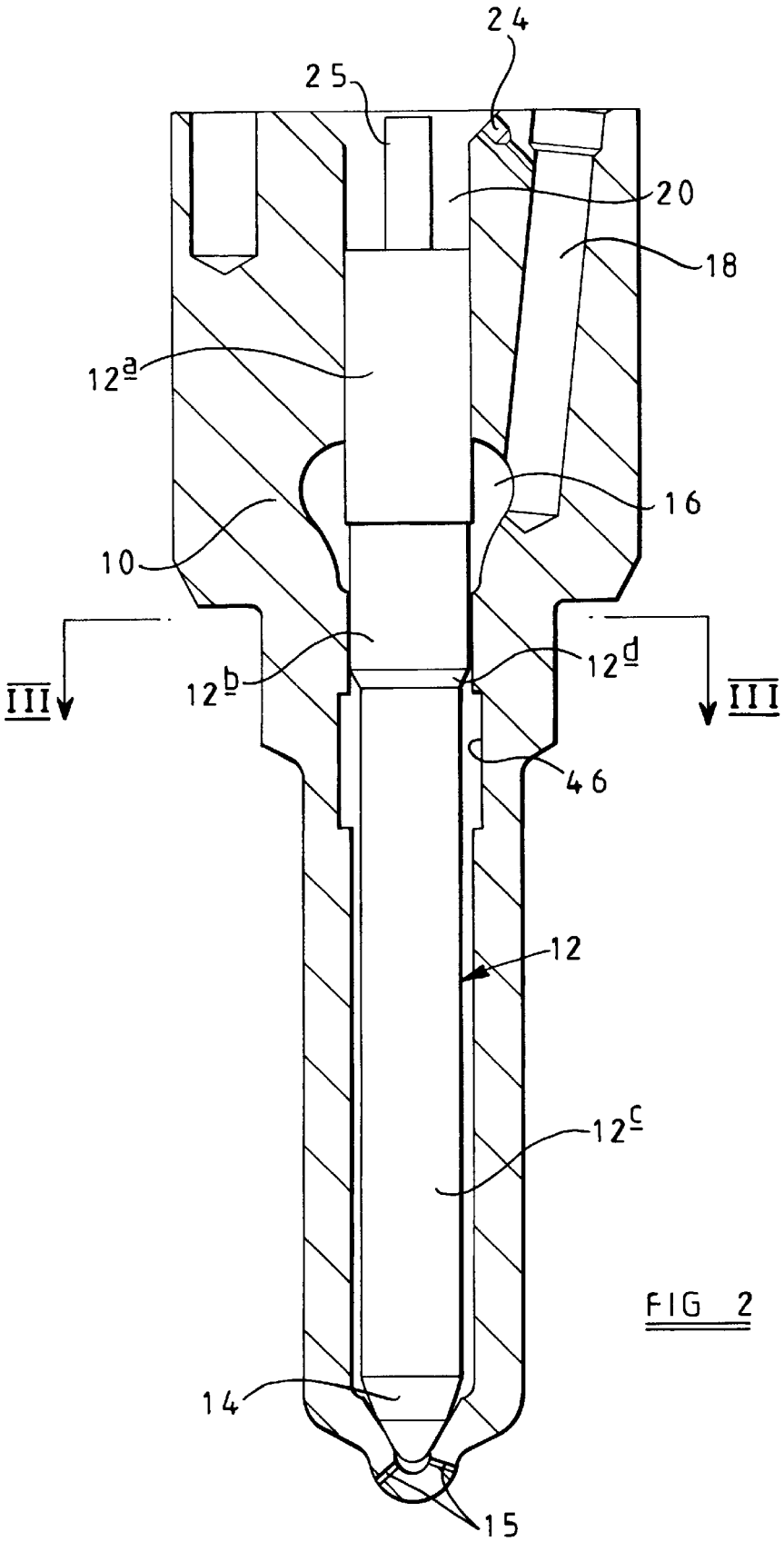
FIG. 2 is an enlarged view of part of the injector of FIG. 1.

As illustrated most clearly in FIG. 2, the valve needle 12 includes a first region 12*a* which is of diameter substantially equal to that of the bore thus forming a substantially fluid tight seal between the annular gallery 16 and the control chamber 20. Downstream of the annular gallery 16 the valve member 12 includes a second region 12*b* which is of diameter slightly smaller than that of the first region 12*a*. The second region 12*b* of the valve member is located within a part of the bore of the same diameter as that within which the first region 12*a* is located. It will be appreciated, therefore, that a restricted flow path exists between the second region 12*b* of the valve member 12 and the nozzle body 10. Downstream of the second region 12*b*, a third region 12*c* of reduced diameter is located, a frustoconical surface 12*d* being located between the second region 12*b* and the third region 12*c* . The conical end region 14 is located at the downstream end of the third region 12*c*. The surface 12*d* and any exposed part of the conical end surface 14 form thrust surfaces which are exposed to the fuel pressure within the bore, the fuel pressure within the bore acting on the thrust surfaces to exert a force on the needle 12 tending to lift the needle away from its seating.

In use, in the position illustrated in the accompanying drawings, the electromagnetic actuator 441 is not energised, thus the valve member 36 occupies a position in which an end thereof seals against the first distance piece 26. Fuel at high pressure is supplied to the supply line 18, thus the fuel pressure within the control chamber 20 is high. As the valve member 36 is in engagement with the first distance piece 26, fuel is not permitted to flow from the control chamber 20 to the low pressure drain. High pressure fuel further acts against the thrust surfaces 12*d*, 14 of the valve needle 12, the fuel pressure in the part of the bore downstream of the region 12*b* of the needle being substantially equal to that within the supply passage 18. The area of the valve needle 12 exposed to the pressure within the control chamber 20 is significantly higher than the effective area of the thrust surfaces 12*d*, 14, and addition, the provision of the spring 22 within the control chamber 20 results in the needle 12 occupying a position in which the end 14 thereof engages its seating. Fuel is therefore not permitted to flow to the outlet apertures 15, and injection is not taking place.

In order to commence injection, the actuator 44 is energised to lift the valve member 36 away from the first distance piece 26. Such movement of the valve member 36 permits fuel to flow from the control chamber 20 through the opening 30 and recess 28 to the low pressure drain. As fuel is permitted to escape from the control chamber 20, and the flow of fuel to the control chamber 20 is restricted by the restricted passage 24, the pressure within the control chamber 20 falls thus the force acting on the valve needle 12 urging the valve needle into engagement with its seating falls and a point will be reached beyond which the pressure acting against the thrust surfaces 12*d*, 14 is sufficient to lift the valve needle 12 away from its seating. Such movement of the valve needle permits fuel to flow to the outlet apertures 15, and hence injection commences.

Before the valve needle 12 commences movement away from its seating, the pressure upstream of the seating is substantially equal to that within the supply passage 18. As the needle 12 moves away from its seating, fuel begins to flow through the outlet apertures 15, and at the same time, the movement of the valve needle 12 results in the volume available for fuel to occupy downstream of the restriction increases. As the flow of fuel to the part of the bore downstream of the restriction is limited by the restrictor, the increase in volume together with the flow of fuel through the outlet apertures 15 results in the pressure applied to the thrust surfaces 12*d*, 14 falling. The force urging the needle 12 away from its seating is therefore reduced. It will be appreciated that the rate of movement of the needle 12 away from its seating is, to some extent, self-governing, the higher the rate of needle movement, the greater the rate of decrease of the pressure acting on the thrust surfaces, thus the lower the force urging the valve needle away from its seating. The injection rate during this phase of injection is reduced both due to the flow area past the seating being restricted and because the fuel pressure applied thereto is reduced.

Once the needle 12 is fully lifted from its seating, the end of the needle engaging the distance piece 26, the required flow rate through the restriction to maintain the pressure downstream of the restriction is reduced as the volume downstream of the restriction is no longer increasing. The pressure downstream of the restriction therefore rises to a level greater than that achieved during movement of the needle away from its seating, but lower than the pressure in the supply passage 18. The pressure downstream of the restriction during movement of the valve needle and whilst the valve needle occupies its fully lifted position is dependent upon the relative flow areas of the restriction and the outlet apertures 15. It is envisaged that the flow area of the restriction will be approximately twice the flow area of the outlet apertures.

When injection is to be terminated, the actuator 44 is de-energised resulting in the valve member 36 returning to the position shown in which it engages the first distance piece 26. Such movement of the valve member 36 breaks the communication between the control chamber 20 and the low pressure drain, and the supply of fuel to the control chamber 20 through the restricted flow path 24 results in the pressure within the control chamber increasing. The increased pressure within the control chamber 20 is sufficient to apply a force to the needle 12 of sufficient magnitude to result in the needle 12 returning to the position shown in the drawings in which it engages the seating. Such movement of the needle 12 occurs relatively quickly as the pressure applied to the thrust surfaces 12*d*, 14 is restricted due to the restricted flow path between the second region 12*b* and the nozzle body 10. As only a small increase in the pressure applied to the control chamber 20 is required in order to result in movement of the valve needle 12 into engagement with its seating, control of the injector is relatively simple.

Once the valve needle 12 has returned into engagement with its seating, the flow of fuel past the second region 12*b* results in the pressure applied to the thrust surface 12*d*and part of the thrust surface 14 exposed to the pressure within the bore increasing to the pressure of fuel within the supply line 18, and thereafter the injector is ready for the commencement of a subsequent injection cycle.

As shown in FIG. 2, the bore is provided with a region 46 of enlarged diameter downstream of the second region 12*b*, and it is thought that appropriate selection of the volume of the region 46 can be used to control the rate at which the valve needle moves away from its seating, the chamber acting in effect as an accumulator. For example, where the chamber is of relatively large volume, the increase in the volume available for fuel to occupy is relatively low compared to the total volume, and thus will not result in a significant change in the pressure applied to the thrust surfaces. If the accumulator were of negligible volume, such movement of the valve needle would result in a greater change in the pressure applied to the thrust surfaces. It is further thought that by increasing the volume of the annular gallery 16, the effect of pressure fluctuations which occur in the supply passage 18 during injection can be reduced.

Figure 3:
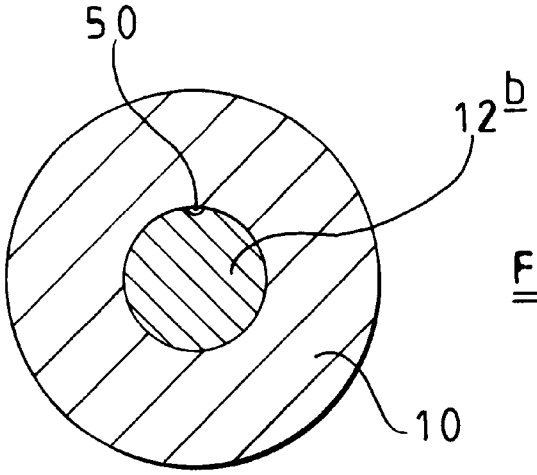
FIG. 3 is a cross-sectional view of the injector taken along the line III—III of FIG. 2, illustrating a restriction formed by providing a groove.
Figure 4:
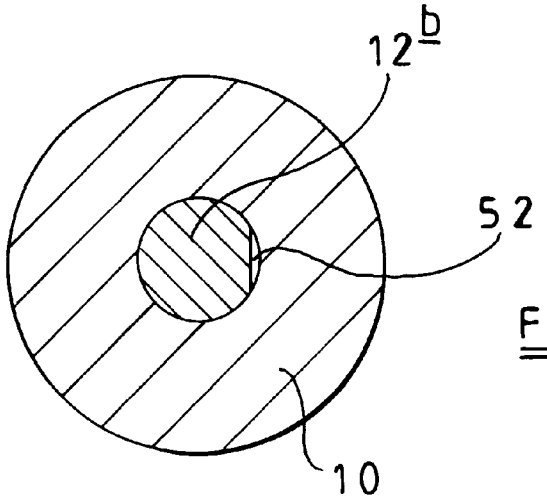
FIG. 4 is a cross-sectional view of a restriction formed by a flat surface.
Figure 5:
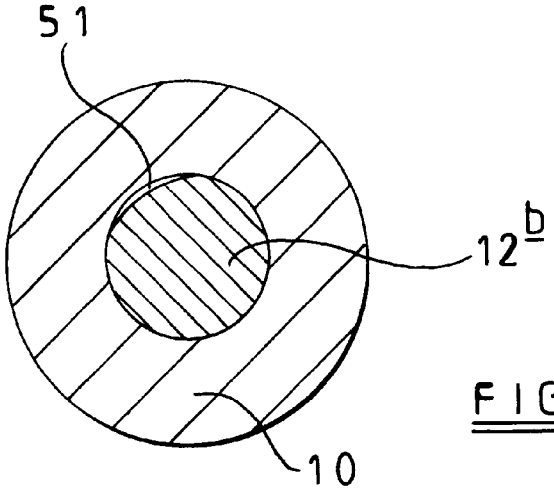
FIG. 5 is a cross-sectional view of a restriction formed by a different radius of curvature.

Although in the description hereinbefore the restriction takes the form of an annular flow path of relatively small cross-sectional area, the restriction could be obtained by extending the axial length of the first region 12*a*, and omitting the second region 12*b*, the thrust surface 12*d* defining the boundary between the first region 12*a* and the third region 12*c*, and by changing the cross-sectional shape of the first region 12*a*, for example by providing one or more grooves 50 (FIG. 3), a region having a different radius of curvature 51 to the bore (FIG. 5), or a flat surface 52 therein to define a flow path between the gallery 16 and the part of the bore downstream of the thrust surface 12*d*.

The injector described hereinbefore is intended for use in a fuel system of the type in which the supply line 18 is continuously supplied with fuel at high pressure, such a fuel system being known as a common rail fuel system. It will be appreciated that the invention is also applicable to pump injector arrangements in which a separate pump forms part of the injector and supplies fuel at high pressure to the injector needle at an appropriate time in the injection cycle. The invention is also applicable to injectors which are not electronically controlled, the injectors being arranged to be opened solely by the application of fuel at high pressure thereto.

I claim:

1. An injector comprising a nozzle body provided with a bore and defining a seating, a fuel flow path along which fuel flows, in use, towards the seating, a needle slidable through a range of movement within the bore and engagable with the seating to control fuel flow to an outlet aperture, the needle including a thrust surface against which fuel at high pressure acts, in use, to lift the needle from its seating, the bore and needle together defining a restriction to the flow of fuel along the fuel flow path towards the seating, the restriction being located upstream of the thrust surface, wherein the restriction is arranged to restrict the rate of flow of fuel towards the seating throughout the range of movement of the needle.

2. An injector as claimed in claim 1, wherein the restriction is arranged such that the rate of fuel flow towards the seating through the restriction is related to the separation of the needle from the seating.

3. An injector as claimed in claim 1, wherein the flow area of the restriction is substantially equal to twice that of the outlet aperture.

4. An injector as claimed in claim 1, wherein the bore and needle are of circular cross-section, the restriction having a flow area of annular shape.

5. An injector as claimed in claim 1, wherein at least one of the needle and the bore is of non-circular shape.

6. An injector as claimed in claim 5, wherein at least one groove is provided in at least one of the needle and the bore.

7. An injector as claimed in claim 5, wherein at least one of the needle and the bore includes a flat region.

8. An injector as claimed in claim 5, wherein at least one of the needle and the bore includes a region of radius of curvature different to that of the remainder thereof.

* * * * *